US005305900A

United States Patent [19]

Maguire et al.

[11] Patent Number: 5,305,900

[45] Date of Patent: Apr. 26, 1994

[54] POSITIVE-SEALING BOTTLE CAP

[76] Inventors: Paul R. Maguire, 4284 Sea View La., Los Angeles, Calif. 90065; John M. Lown, 6622 Silverspur La., Huntington Beach, Calif. 92648

[21] Appl. No.: 29,035

[22] Filed: Mar. 10, 1993

Related U.S. Application Data

[63] Continuation-in-part of Ser. No. 961,479, Oct. 15, 1992.

[51] Int. Cl.[5] ..... B65D 39/00

[52] U.S. Cl. ..... 215/245; 215/260; 215/307; 215/355; 220/203; 220/254; 220/335; 220/338; 220/344; 220/366; 222/546

[58] Field of Search ..... 215/235, 237, 238, 244, 215/245, 260, 270, 307, 355; 220/202, 203, 254, 263, 264, 335, 337, 338, 344, 366; 222/545, 546, 556, 568

[56] References Cited

U.S. PATENT DOCUMENTS

| | | | |
|---|---|---|---|
| 1,470,686 | 10/1923 | Carpenter | 222/545 X |
| 3,113,693 | 12/1963 | Stull | 222/546 X |
| 3,168,221 | 2/1965 | Parker | 222/556 X |
| 3,201,014 | 8/1965 | Livingstone | 222/545 |
| 3,610,460 | 10/1971 | Siklos et al. | 220/344 X |
| 3,799,408 | 3/1974 | Palmer | 222/556 X |
| 4,938,395 | 7/1990 | Jamieson | 215/100 X |
| 4,982,855 | 1/1991 | Hertrampf | 215/235 |
| 4,993,606 | 2/1991 | Bolen, Jr. et al. | 222/546 |
| 5,125,523 | 6/1992 | Kulper | 220/4.23 |
| 5,145,646 | 9/1992 | Tyranski | 215/235 X |

*Primary Examiner*—Gary E. Elkins
*Assistant Examiner*—Stephen Cronin
*Attorney, Agent, or Firm*—Harold L. Jackson

[57] ABSTRACT

An improved bottle cap device formed so as to have a positive sealing arrangement for use with bottles that store gaseous fluid such as soda water and like beverages, wherein the bottle cap device includes a threaded cap body and a hinged cover or lid that is formed having a sealing annular structure which compresses an annular gasket against the mouth of the bottle by a depending convex wall that engages a gasket mounted when the cover is locked in a close sealed position and a pressure release latch for limiting the movement of the hinged cover after it is unlocked from the cap body to relieve pressure within the bottle.

16 Claims, 2 Drawing Sheets

POSITIVE-SEALING BOTTLE CAP

BACKGROUND OF THE INVENTION

1. Related Application

This is a continuation-in-part of application Ser. No. 07/961,479, filed Oct. 15, 1992, for Positive-Sealing Bottle Cap.

2. Field of the Invention

The present invention relates to an improved bottle cap device and more particularly to a bottle cap that is formed having a positive sealing and a pressure release arrangement for use with bottles that store gaseous liquid such as soda water and like carbonated beverages.

3. Description of the Prior Art

Many types of cap devices are presently in use and they vary in configuration and how they are capped on a bottle. This is generally due to the configuration of the bottle in which the soda is stored. Some known soda-bottle caps are just simple plastic snap-on units or caps having internal threads that match particular bottle arrangements and these caps have no particular sealing arrangement. Both of the types of caps often do not provide proper sealing to prevent gases within the soda water from slowly leaking out. When the gas is allowed to escape from the bottled soda it is no longer desirable since it becomes what is referred to as "flat".

Therefore, such bottle caps generally have inherently poor sealing qualities. This is particularly true with bottle caps that are mounted to the larger 2 liter soda bottles commonly sold in markets, liquor stores, drug stores and like places. These bottles are often provided with soft aluminum caps that are fixedly sealed to the thread outlet neck portion of the bottle. This type of cap is removed from a bottle by rotating the cap so as to force it to break loose from an integrally formed holding ring member. Many times, the soft metal caps are distorted by the force required to remove them, causing the cap to lose its circular shape which then prevents it from being properly sealed, and allows the gases to leak out of the bottle.

Accordingly, there is a need for a sealing cap that is simple to operate and yet provides a very positive seal when remounted to the threaded neck portion of a 2 liter plastic bottle or other container.

SUMMARY OF THE INVENTION

The present invention comprises a novel bottle cap or cover member that is hingedly mounted to a cap body that is internally threaded so as to be readily secured to any compatible threaded neck portion of a soda bottle. The capping lid or cover is formed having an annular wall structure that is adapted to engage a gasket member in a tight sealing manner. The capping lid and cap body have cooperating pressure release means for arresting the movement of the lid after the annular wall structure has disengaged the gasket to relieve any pressure within the bottle. A hinge device may be provided between the snap lid or cover and the cap body, wherein a hinge is formed having a pivot pin that includes a latch arrangement which allows the lid to be held in an open position with respect to the cap body as the soda or other gaseous liquid is poured from the bottle.

Accordingly, it is an object of the present invention to provide an improved bottle cap that is particularly designed to be used with large plastic-type soda bottles and more particularly with 2 liter bottles that are provided with a screw cap. These bottles are commonly found in most stores today as they are used by most producers of various gaseous drinks from carbonated water to soda pop.

Another object of the invention is to provide an improved bottle cap that includes a unique sealing arrangement wherein the cover or lid is hingedly mounted to the cap body which is internally threaded so as to be screwed to the existing threads on the neck portion of the typical 2 liter soda bottle. The hinged lid is defined by an annular wall structure e.g., in the form of an inverted section of a dome so as to establish a positive sealing engagement with the inner annular sealing lip of the gasket member and the inner circular edge of the mouth of the bottle. This arrangement will automatically cause a positive aligned sealing engagement between the gasket and the inverted dome wall structure and the bottle mouth.

Still another object of the present invention is to provide a sealable and lockable lid having the above characteristics, whereby a positive sealing arrangement is provided to substantially extend the shelf life of stored bottled gaseous fluids well beyond that possible with any of the simple cap devices now employed for the same purpose.

A further object of the present invention is to provide a device of this character having a pressure release catch mechanism for limiting the movement of the lid until the pressure within the bottle has been relieved.

Still a further object of the invention is to provide a bottle cap device of this character that is relatively inexpensive to manufacture and is simple but rugged in construction.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

With the above and related objected in view, the invention consists in the details of construction and combination of parts, as will be more fully understood from the following description when read in conjunction with the accompanying drawings and numbered parts, in which.

DESCRIPTION OF THE PREFERRED EMBODIMENT

Figure 1:
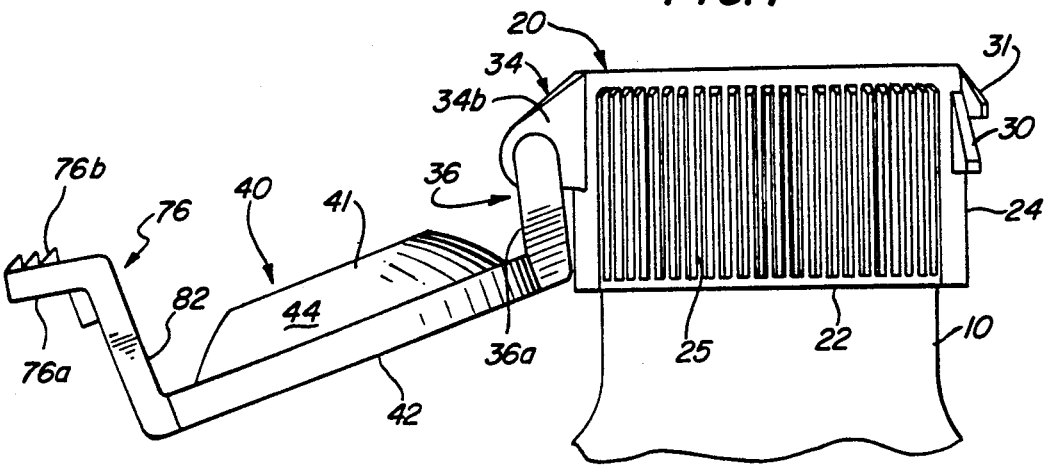
FIG. 1 is a side elevational view of the upper portion of a typical soda bottle on which there is illustrated the present invention that defines a bottle-sealing device having a hinged sealing lid or cover member which is shown in a secured open position on the cap body.

Referring more particularly to FIG. 1, there is shown an upper portion of a typical plastic soda bottle or other like bottle that is formed having a threaded neck portion 10. The soda bottle may be the commonly used 2 liter size that has become a popular bottle size now available at most super markets and convenience stores. As previously mentioned, this type of bottle is normally provided with a sealed soft metal or plastic cap (not shown) that is threadably secured to threads 12 that are formed in the upper portion of neck 10 of the bottle In the cross-section of FIG. 5, the neck portion 10 is shown with an annular outer wall member 14 that defines an opening or mouth 13 which includes an upper planer surface 13*a* and an inner circular edge 13*b*. The receiving threads 12 are formed in neck 10 just below the mouth 13 as illustrated.

Figure 8:
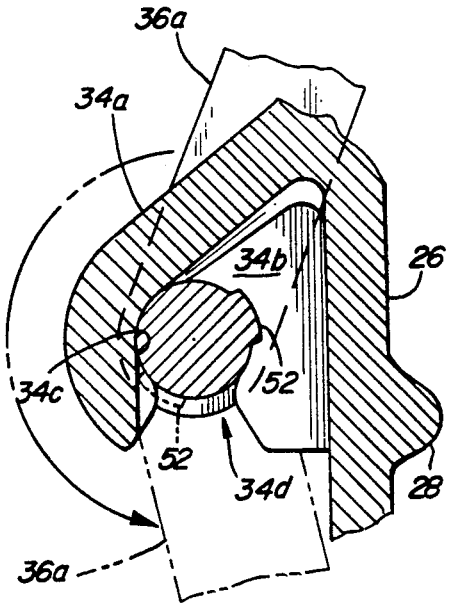
FIG. 8 is an enlarged cross-sectional view of the hinge connection of the sealing cap illustrating the latch arrangement in the hinge for holding the lid in an open position.
Figure 3:
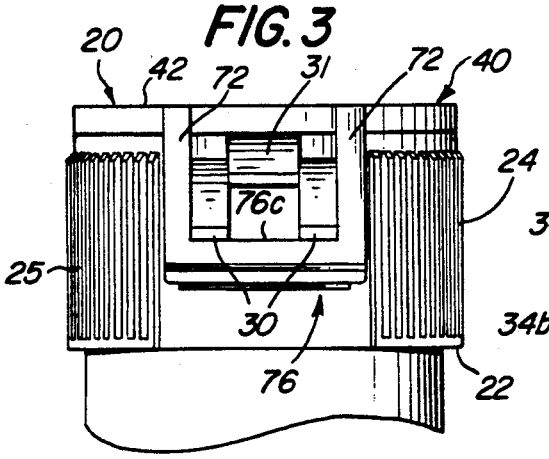
FIG. 3 is a front elevational view of the bottle sealing cap in a closed locked position.
Figure 5:
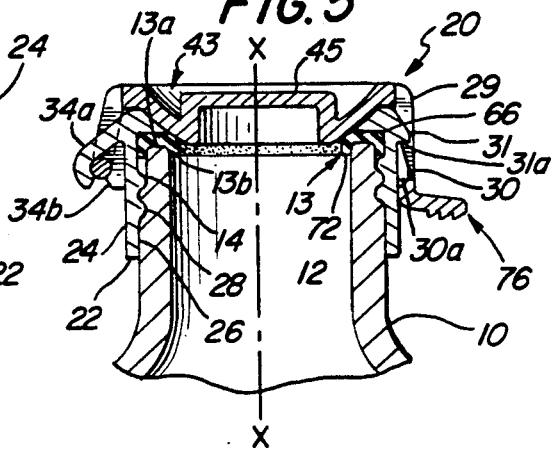
FIG. 5 is a cross-sectional view taken substantially along line 5—5 of FIG. 4 showing the cap body screwed to the threaded neck of the bottle.
Figure 4:
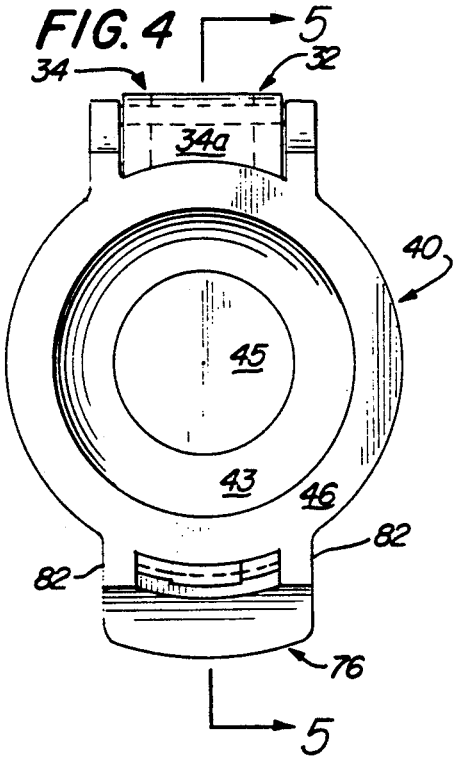
FIG. 4 is a top plan view of the bottle-sealing cap in a closed and locked position.

Threadably mounted to threaded neck portion 12 is the present invention which is defined as a bottle cap device, generally designated at 20 which may be made of a suitable plastic such as plastic elastomer. A suitable thermal plastic elastomer for the bottle cap device is sold by Shell Chemical Co. under its trademark "Kraton". Bottle cap device 20 is formed with a cap body 22, as seen in FIGS. 1, 3, and 5 which is defined by a cylindrical wall 24 having an inner surface 26 formed with internal threads 28. The external surface of the wall 24 (except for the areas occupied by a hinge and locking mechanisms to be described) is provided with longitudinal grooves 25 to provide a gripping surface for a user's fingers. These threads are arranged to be threadably compatible with the threads 12 of the bottle. The cap body defines an inwardly projecting shoulder 29 which is arranged to extend over the upper surface 13*a* of the mouth of the bottle and compress a gasket to be described against the surface 13*a* for sealing purposes. The outer surface of wall 24 of the cap body is formed with a cap-locking means that is defined by a pair of outwardly projecting locking hooks 30 and a lid arresting hook 31 for limiting the initial movement of the lid (to be described) to relieve the pressure within the bottle. Also formed in wall 24 is a hinge means which is oppositely disposed to that of hooks 30 and 31. The hinge means, designated generally at 32, comprises an upper hinge arm member 34 formed integrally with the cap body 22 and a lower hinge arm member 36 formed integrally with a cover lid or cover cap 40. The upper hinge arm member 34 includes an outwardly and downwardly extending wall 34*a* and a pair of end walls 34*b* which form two semicircular recesses 34*c* with downwardly facing openings 34*d* aligned in a direction substantially parallel to the longitudinal axis x—x of the cap body and bottle 10 as is illustrated in FIGS. 5 and 8. The openings 34*d* are slightly smaller than the semicircular recesses 34*c* to retain a pivot pin (36*b*) which forms a part of the lower hinge arm member 36 to be described.

The lower hinge member 36 includes a pair of spaced downwardly extending arms 36*a* and the pivot pin 36*b* extending between the ends of the arms 36*a*. See FIG. 2. The pivot pin 36*b* is snapped into the semicircular recesses 34*c* for rotation therein.

Figure 2:
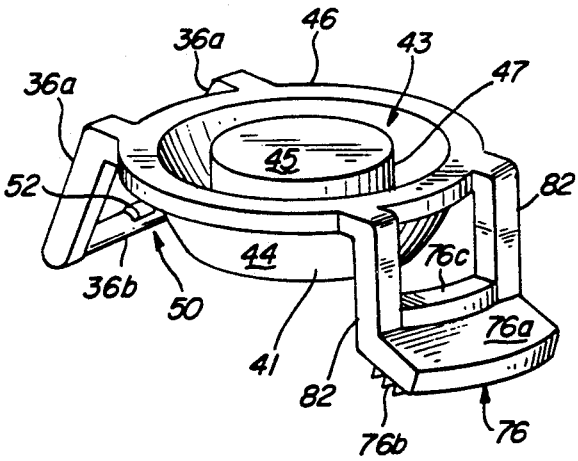
FIG. 2 is a perspective view of the sealing lid or cover showing it removed from the cap body member.
Figure 7:
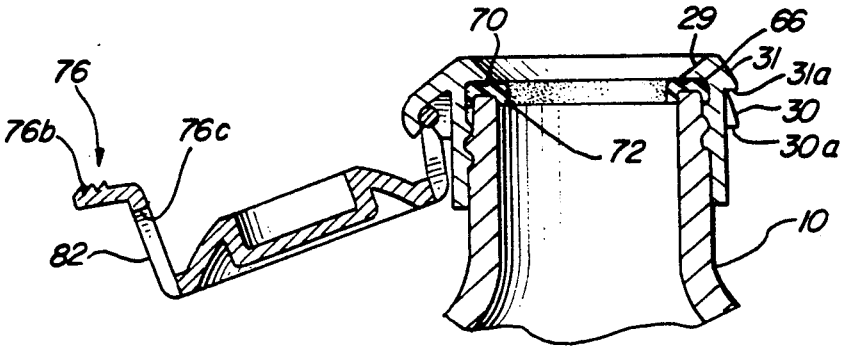
FIG. 7 is a cross-sectional view of the bottle sealing cap in its fully open position.

The cover lid 40 includes a top wall 42 which is formed having an annular V-shaped channel 43 defined by an outer curved wall 44 and an inner vertical wall 47, whereby curved wall 44 provides a convex semi-spherical gasket-engaging surface which has the appearance of a section of an inverted dome member. Channel 43 further defines a central hub member 45 as part of top wall 42. An annular lip member 46 establishes the outer peripheral edge of lid 40 and covers the upper peripheral edge of cap body 22. Pivot pin 38 is provided with a latch-positioning means, designated generally at 50, which comprises an elongated rib member 52 that is formed longitudinally along the upper side of pin 36*b* when sealing cap cover 40 is in a closed position, as seen in FIG. 2. Latch-positioning means 50 also includes the narrowed opening 34*d* to the pin receiving recess 34*c* as is illustrated in FIG. 8. Cover lid 40 is thus rotatably mounted via hinge 34 so as to rotate between an open and closed sealed position, as illustrated in FIGS. 5 and 7. That is, when the cover 40 is in a closed and locked position, as seen in FIGS. 3 and 5, rib member 52 is facing upwardly and is free to be rotated to an open position when cover lid 40 is disengaged from the hooks 30 and 31. To pour the fluid from the bottle, the cover lid 40 is rotated rearwardly to the position as shown in FIG. 1 and is then latched in an open position as rib 52 moves out of the opening 34*d* in the side walls 34*b* of the upper hinge arm member 34.

When in a sealed closed position, cover lid 40 and the semi-spherical sealing surface 44 thereof is forced against a sealing means, designated at 66, which comprises an annular gasket 70 positioned between the shoulder 29 of the cover lid 40 and the upper surface 13*a* of the neck of the bottle as illustrated. The gasket includes an inner annular, inclined, sealing lip member 72 that is arranged in such a manner as to provide a very positive and stable seal when it is engaged with the convex semi-spherical gasket-engaging wall 44, thereby preventing gases in the soda water 75 from escaping through the neck of the bottle. The engaging lip member 72 of the gasket is compressed between the inner circular edge 13*a* of the mouth of the bottle and the curved wall 44 of the inverted dome member to provide a unique and positive seal. The configuration of the semi-spherical wall structure (44) of the cover lid 40, together with the overlapping of the inclined annular lip member 72, provides a self-adjusting sealing means for accommodating a misalignment between the upper surface of the bottle neck and the cap 40, not found in any known cap device. The self adjusting feature results, at least in part, because the surface of the semi-spherical wall 44 of the inverted dome member which engages the gasket lip is circular whether or not the plane of the top of lid 40 is parallel to the plane of the bottle mouth.

The cover lid 40 is locked to the cap body 22 to compress the sealing lip member 72 of the gasket 70 between the annular sealing surface 44 and the inner circular edge 13*a* of the mouth of the bottle by a locking means which comprises the pair of lower locking hooks 30 on the cover body, discussed previously, and a locking tongue 76 affixed to the cover lid 40 by means of a pair of front leg member 82, as is illustrated in FIGS. 1, 2, 3, 4 and 5. The locking tongue 76 has an outwardly projecting flange 76*a* with serrations 76*b* on the bottom thereof and a hook engaging ledge 76*c* (FIG. 7) which is disposed parallel to the top wall 42 (and perpendicular to the axis x—x in the closed position). See FIG. 2.

In the closed or locked position the hook engaging ledge 76*c* of the locking tongue 76 is snapped under the lower edges 30*a* of the hooks 30 as is illustrated in FIG. 5. The lower edges 30*a* (like the ledge 76*c*) are also disposed in a plane parallel to the top wall 42 to ensure that a sufficient locking force exists between the locking tongue 76 and the hooks 30 to withstand any anticipated pressure (e.g., 30–80 psia or more) build up in the bottle to which the bottle cap 20 is affixed. To open the cover lid, a user may simply grasp the serrated portion 76*b* of the locking tongue with a finger and force it outwardly from the cover body until the ledge 76*c* is free from the lower edges 30*a* of the hooks 30.

Figure 6:
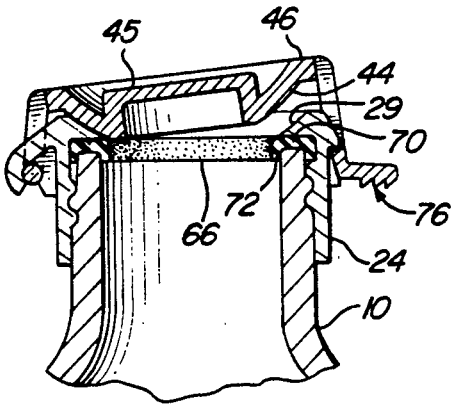
FIG. 6 is a cross-sectional view of the bottle sealing cap in its pressure release position.

To prevent the pressure build-up within the bottle from rotating the cover lid with sufficient acceleration to startle the user, the lid arresting hook 31 and specifically the lower edge 31*a* thereof (also aligned parallel to the top 42) is arranged to catch the hook engaging ledge 76*c* of the locking tongue 76 as is illustrated in FIG. 6. In this position the cover lid is partially open to relieve the pressure within the bottle. For example, the cover lid may pivot about the hinge through an angle within the range of about 2° to 15° and preferably about 7° to 8° in the pressure relief position. The lower edges of the hooks 30 and 31 need to be separated a sufficient distance (e.g., about ⅛") to allow the locking tongue to catch the lid arresting hook 31 after it has been disengaged from the hooks 30.

Once the pressure has been relieved the locking tongue may be disengaged from the arresting hook 31 and the lid rotated into the latched open position as discussed previously. It should be noted that the alignment of the openings 34*d* (downward and parallel to the axis x—x) in the upper hinge member 34 serves two functions. This alignment facilitates the assembly of the cover lid to the cap body i.e., the pivot pin 36*b* may be placed against the opening 34*d* and the lid rotated to a closed position to snap the pin into the recesses 34*c*. This alignment also serves to prevent the lid from being detached from the cap body in the event that the arresting hook 31 fails to catch the locking tongue (and relieve the pressure) when the lid is opened.

It may be thus seen that the objects of the present invention set forth herein, as those made apparent from the foregoing description are efficiently attained. While preferred embodiments of the invention have been set forth for purpose of disclosure, modifications of the disclosed embodiments of the invention as well as other embodiments thereof may occur to those skilled in the art Accordingly, the appended claims are intended to cover all embodiments which do not depart from the spirit and scope of the invention.

What is claimed is:

1. A bottle cap device for sealing gaseous liquids stored within a bottle having a threaded neck portion, said bottle cap device comprising:

a cap body member having an annular wall with an outer surface and an inner surface, said inner surface being formed with threads, whereby said bottle cap device is adapted to be threaded to the neck portion of the bottle;

a cover lid member;

a hinge means mounted between said lid member and said cap body member, whereby said lid member may be pivoted at said hinge means from a closed position to an open position;

locking means positioned between said lid member and said cap body member, the locking means comprising at least one locking hook on the cap body member and a locking tongue on the lid member, whereby said lid member is held by said locking means in a sealed locked position; a gasket mounted within said cap body member;

sealing means formed as part of said lid member so as to engage said gasket, whereby a positive seal is established between said sealing means and said gasket; and pressure release means for arresting the movement of the lid member after the disengagement thereof from said gasket to allow gas to escape from the bottle and relieve any pressure build up therein.

2. A bottle cap device as recited in claim 1, wherein the pressure release means comprises a lid arresting hook on the cap body, the lid arresting hook being positioned above the locking hook whereby the locking tongue engages the lid arresting hook when the lid member is in a partially open pressure release position.

3. A bottle cap device as recited in claim 2 wherein the lid arresting hook and locking tongue are constructed and arranged to allow the lid member to rotate about the hinge means through an angle within the range of about 2° to 15° from its sealed and locked position to its pressure release position.

4. A bottle cap device as recited in claim 3 wherein the cap body member has a longitudinal axis arranged substantially parallel to the neck portion of the bottle when installed thereon and wherein the hinge means comprises an upper hinge arm member affixed to the cap for defining a substantially semicircular recess with an opening being downwardly and parallel to the longitudinal axis and a pivot pin affixed to the cover lid and positioned within the opening for rotation therein, whereby the cover lid member is substantially prevented from being detached from the cap body member due to a rapid rotation of the lid member.

5. A bottle cap device as recited in claim 3 wherein said at least one locking hook comprises a pair of spaced hooks.

6. A bottle cap device as recited in claim 5 wherein the lid arresting hook is positioned above and between the locking hooks.

7. A bottle cap device as recited in claim 3 wherein the cap body member has a longitudinal axis and wherein each of the locking and lid arresting hooks defines a substantially flat lower surface extending in planes perpendicular to the longitudinal axis.

8. A bottle cap device as recited in claim 7 wherein the locking tongue defines a substantially flat ledge for engaging the flat surfaces of the locking and lid arresting hooks, the flat edge being aligned substantially perpendicular to the longitudinal axis of the cap body member when the lid is in a closed and sealed position.

9. A bottle cap device as recited in claim 8 wherein the arresting hooks and locking tongue are arranged to allow the lid member to rotate about the hinge means through an angle of about 7° to 8° from its closed to its pressure release position.

10. A bottle cap device as recited in claim 8 wherein the locking tongue further includes an outwardly projecting flange arranged to be grasped by a finger of the operator and forced outwardly of the body member for releasing the locking tongue from the locking and lid arresting hooks.

11. A bottle cap device as recited in claim 10 wherein the cap body member and the cover lid member are made of an elastomer plastic.

12. A bottle cap device as recited in claim 3, wherein the sealing means comprises a centrally disposed, convex, sealing member formed in said lid member.

13. A bottle cap device as recited in claim 12, wherein the bottle neck further has a upper planer surface and a mouth with an inner edge and wherein:

the cap body member includes an inwardly projecting shoulder adapted to extend over the upper planer surface of the bottle neck;

the gasket including an annular ring member adapted to extend between the inwardly projecting shoulder of the cap body and the upper planar surface of the bottle neck and a sealing lip member extending inwardly from the annular ring member; and the sealing means comprises a semi-spherical surface adapted to compress the sealing lip member of the gasket against the inner edge of the mouth of the bottle in the closed position.

14. A bottle cap device as recited in claim 13 wherein the hinge means comprises:

an upper hinge arm member formed integrally with the body cap member which defines two spaced semicircular recesses with downwardly facing openings thereto aligned parallel to the longitudinal axis; and a lower hinge arm member formed integrally with the cover lid member and including a pair of spaced arms extending downwardly and outwardly when the cover lid member is in the closed position and a substantially cylindrical pivot pin extending between the arms.

15. In combination with a bottle used for the storage of gaseous fluids of the type wherein the bottle is formed having a threaded discharge neck portion, the improvement comprising:

a bottle cap having an annular body member with an open end and internal threads formed therein, whereby said bottle cap is threadably secured to the threaded neck portion of the bottle and a cover member for the open end of the body member;

means hingedly connecting the cover member and the body member whereby the cover member may be rotated with respect to the body member;

locking means positioned between the cover member and the body member, the locking means comprising at least one locking hook on the cover member and a locking tongue on the body member, whereby the cover member is locked in a sealed position to prevent gaseous fluid from exiting the neck portion of the bottle;

a gasket mounted within said cap body member;

an annular sealing member formed as part of said cover member so as to engage said gasket whereby a positive seal is established between said cover member and said gasket and said discharge neck portion of the bottle; and pressure release means positioned between the cover member and the body member for selectively limiting the rotation of the cover member when the cover member is not in a locked and sealed position.

16. The invention of claim 15 wherein the pressure release means comprises a cover member arresting hook on the cover member, the cover member arresting hook being positioned above the locking hook, whereby the locking tongue engages the cover member arresting hook when the cover member is in a partially open pressure release position.

* * * * *